United States Patent [19]

Bruhm

[11] Patent Number: 4,462,183

[45] Date of Patent: Jul. 31, 1984

[54] GARDEN WINDOW WITH HIDE-AWAY SCREEN

[76] Inventor: Ronald R. Bruhm, 707 Arrow Rd., Weston, Ontario, Canada, M9M 2L4

[21] Appl. No.: 417,229

[22] Filed: Sep. 13, 1982

[51] Int. Cl.[3] ..... A47G 7/00

[52] U.S. Cl. ..... 47/40

[58] Field of Search ..... 47/40; 49/61, 60; D25/53

[56] References Cited

U.S. PATENT DOCUMENTS

| | | | |
|---|---|---|---|
| 1,432,790 | 10/1922 | Robertson | 49/60 |
| 3,127,697 | 4/1964 | Romenko | 47/40 |
| 3,319,378 | 5/1967 | Andrews et al. | 47/40 |

*Primary Examiner*—Robert A. Hafer

*Assistant Examiner*—Bradley M. Lewis

*Attorney, Agent, or Firm*—K. Maxwell Hill

[57] ABSTRACT

A window garden is comprised of a fixed frame secured to the perimeter of a window opening in a dwelling house and has an outwardly moveable sash frame fixed and hingeable to the top edge of the window frame. A pair of transparent domed members having dead air or vacuum therebetween form a plant displayable enclosure in the window which is protected from frost and obtains maximum winter sunlight when oriented in a southern exposure of a dwelling. Means such as nylon or polypropelene screen material are provided between said fixed and moveable frames to exclude insects when the domed sash frame is moveable outward to allow air to enter therebetween.

2 Claims, 5 Drawing Figures

GARDEN WINDOW WITH HIDE-AWAY SCREEN

FIELD OF INVENTION

The present invention relates to an apparatus and means for installation in a window opening of a dwelling house and the like whereby an outwardly blistered or domed transparent portion thereof is positioned for displaying growing plants in open sunlight. In particular the invention provides a means for supporting plants in an enclosure which can be opened outwardly to allow exit or inlet of air therethrough without disturbing the plants displayed therein.

PRIOR ART

It is common practice for householders in northern climates who desire to grow plants during the winter season indoors to provide means to optimze the amount of sunlight their plants are exposed to while in the dwelling house. Large bay windows having southern exposures is the oldest method of accomplishing the above requirement. The most recent tend is to build greenhouses against the house wall with an entrance for heat and movement to and from the house. The disadvantage of greenhouse attachment to a house is that with limited side yards and building restrictions a building cannot often be added to the wall having the best growing exposure possibility. The need has been found for utilizing the existing windows of a house to display growing plants to larger amounts of sunlight.

OBJECTS OF THE INVENTION

The principal object of the invention is to provide a dome or outward blister to a window surface which has a frame structure within it to display growing plants to the increase sunlight receiving area created by the dome cavity.

It is a further object of the invention to provide a means for supporting the plants freely within a surrounding transparent window enclosure which will allow the window to be opened and closed without disturbing the plants.

It is another object of the invention to provide the domed window of the invention with a frame hinged along one edge thereof, preferably the top edge and having enclosing flexible netting extending continuously around between the dome frame and the fixed window frame.

STATEMENT OF THE INVENTION

A window garden is comprised of a fixed frame secured to the perimeter of a window opening in a dwelling house and has an outwardly moveable sash frame fixed and hingeable to the top edge of the window frame. A pair of transparent domed members having dead air or vacuum therebetween form a plant dispayable enclosure in the window which is protected from frost and obtains maximum winter sunlight when oriented in a southern exposure of a dwelling. Means are provided between said fixed and said moveable frames to exclude insects when the domed sash frame is moveable outward to allow air to enter therebetween.

IN THE DRAWINGS

With the foregoing objects in view and such other objects as may become apparent as this disclosure proceeds, the present invention consists in the following arrangement and construction of parts, all as hereinafter more particularly described, reference being had to the accompanying drawings in which like reference numerals refer to like parts.

THE PREFERRED EMBODIMENT OF THE INVENTION

Figure 2:
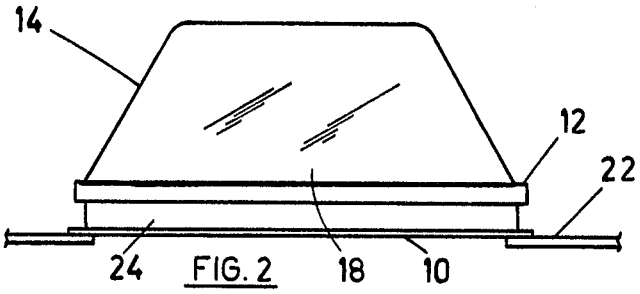
FIG. 2 is a side elevation of FIG. 1 showing the plastic blister in phantom open position.
Figure 1:
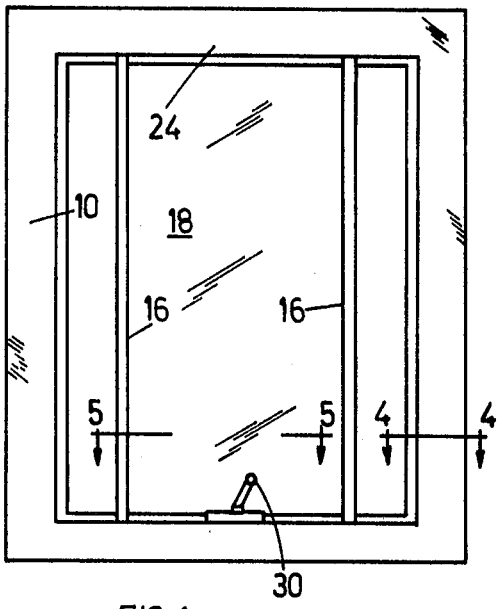
FIG. 1 is a front elevation of the invention.

The invention comprises essentially a fixed frame 10 and a moveable frame 12. A transparent plastic blister or dome 14 perimetrically secured to frame 12. A plant supporting means 16 is adjustably positioned within the cavity enclosure formed by dome or blister 14. Plane 18 generally designates that part of the window opening around whose perimeter the invention is attached. Importantly in connection with the foregoing are the means 20 for maintaining an insect excluding relationship between the two frames. Most usually the fixed frame will be secured in abutting relationship to the outer surface of surrounding wall 22. Moveable frame 12 is preferably connected to frame 10 via the upper edge 24 of the latter to be swingable between approximate the limits 26 shown in FIG. 3, opening and closure being effected by any conventional means 28 for effecting an air tight relationship which as shown is in the form of a toggle asembly. Rotation of the handle 30 which acts through arcurate rack and screw means upon the pairs of arms 32 to move same as indicated by arrows 34, part 36 being secured to fixed frame 10 and part 38 to moveable frame 12. Frame 10 is desirably an extruded form of the x-section illustrated in FIG. 4 and provided with surrounding resilient gasket 40. Frame 12 is likewise an extruded form, but compound, since including the retaining extrusion 42 by means of which the double "glazed" blister 14, is sealably secured as clearly shown.

Figure 3:
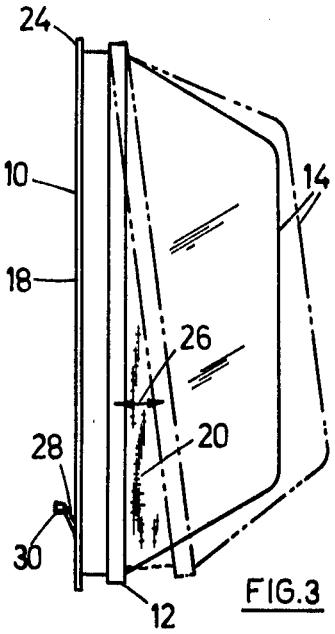
FIG. 3 is a plan view of FIG. 1.
Figure 5:
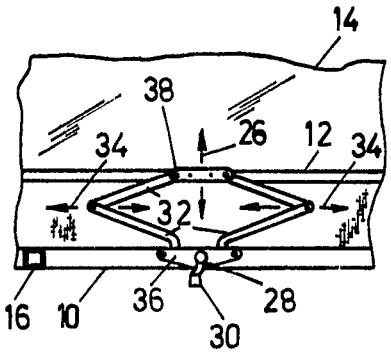
FIG. 5 is a sectional view on the line 5—5 of FIG. 1.
Figure 4:
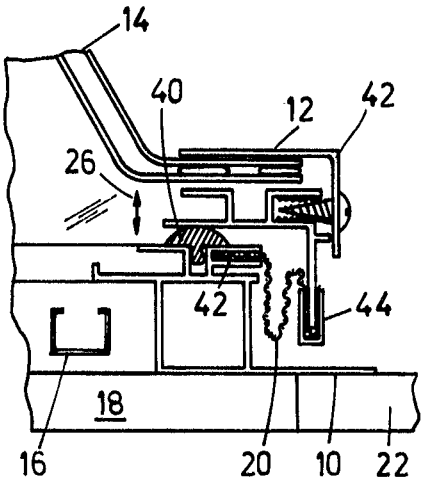
FIG. 4 is a section view on the line 4—4 of FIG. 1.

Means 20 takes the form of flexible wire or elastomeric mesh which is secured also as shown between clip-strips 42 in the frame 10 and 44 on the latter so that in the maximum open position shown in FIG. 3 the stretched mesh may have as seen in the drawings an approximately elongated isosoles triangular form.

The means 16 takes the form of a pair of spaced vertical bars cross-sectionally channel shaped but preferably with inturned edges. These bars are apertured at intervals so that angle brackets may be secured thereto for the reception of shelving upon which plants may be placed free of the surrounding blister 14 and may be there well ventilated on their sides by the adjusting spacing provided between the window attachable frame and the moveable sash frame.

I claim:

1. A window garden for growing and displaying plants within the space enclosed, and to be positioned over the perimeter wall surface bounding a dwelling house window opening, said window garden comprising in combination;

a fixed frame adapted to be secured to the perimeter wall of a dwelling house window opening; an outwardly moveable frame secured in abuttable and sealable relation to said fixed frame by means of a hinge operable between the top edges thereof;

a predominately transparent enclosure bounded by and perimetrically secured to said moveable frame and projecting outwardly therefrom relative to the fixed frame and dwelling wall surface which immediately surrounds said window opening, said enclosure consisting of a pair of nesting plastic blister domes spaced apart with dead air therebetween;

means for maintaining an insect excluding relationship between said fixed and moveable frames in any position of said moveable frame relative to said fixed frame comprising, flexible netting fastened continuously between integrally formed clip strips on the perimeter of and facing outwards of said fixed frame, and integrally formed clip strips facing toward the dwelling house wall and formed with the moveable frame, said clip strips being formed on the bottom and side edges of the frames to provide netting coverage to only that area of exposure between the open frames but not permitting any obscurity to entrance of light to the area covered by the pair of domed blisters composing the enclosure;

a toggle assembly consisting of a rack and screw means rotatable by a handle member fixed to said frame and to a pair of articulated arms attached to the moveable frame and the rack and screw for maintaining the frames in a plurality of spaced apart relationships;

and plant supporting means consisting of a plurality of spaced verticle bars fixed to said fixed frame and holding horizontally disposed shelving therebetween freely within said enclosure.

2. The invention according to claim 1 wherein a resilient gasket is secured to the extruded section comprising the fixed frame to secure the fixed and moveable frames together in water and air excluding mode when the toggle assembly provides a fast closure between the frames.

* * * * *